US007159329B2

(12) United States Patent
Dolenz et al.

(10) Patent No.: US 7,159,329 B2
(45) Date of Patent: Jan. 9, 2007

(54) PICTURE HANGING TOOL

(75) Inventors: George M. Dolenz, 22 Baymare Rd., Bell Canyon, CA (US) 91307; Boyd I. Willat, Los Angeles, CA (US); Gary D. Delgado, New York, NY (US)

(73) Assignee: George M. Dolenz, Bell Canyon, CA (US)

( * ) Notice: Subject to any disclaimer, the term of this patent is extended or adjusted under 35 U.S.C. 154(b) by 0 days.

(21) Appl. No.: 11/270,852

(22) Filed: Nov. 8, 2005

(65) Prior Publication Data

US 2006/0096111 A1 May 11, 2006

Related U.S. Application Data

(60) Provisional application No. 60/626,533, filed on Nov. 9, 2004.

(51) Int. Cl.
*G01D 21/00* (2006.01)
*B25H 7/00* (2006.01)
*B41F 31/00* (2006.01)

(52) U.S. Cl. ..... 33/666; 33/613; 101/327

(58) Field of Classification Search ..... 33/613, 33/666, 670, 673, 679, 677, 668; 101/327, 101/333, 405, 406
See application file for complete search history.

(56) References Cited

U.S. PATENT DOCUMENTS

| | | | | |
|---|---|---|---|---|
| 3,516,165 | A | 6/1970 | Pfeffer | |
| 4,455,756 | A | 6/1984 | Greene | |
| 4,473,957 | A | 10/1984 | Faulkner | |
| 4,517,860 | A * | 5/1985 | Dameron, Jr. | 81/487 |
| 4,893,776 | A * | 1/1990 | Floyd | 248/475.1 |
| 5,109,611 | A | 5/1992 | Houck | |
| 5,129,154 | A | 7/1992 | Aydelott | |
| 5,180,135 | A | 1/1993 | Hindall | |
| 5,416,978 | A * | 5/1995 | Kaufman | 33/770 |
| 5,471,760 | A | 12/1995 | Farris | |
| 5,520,318 | A | 5/1996 | Sloop | |
| 5,867,917 | A | 2/1999 | Karon | |
| 6,049,991 | A | 4/2000 | Gruenberg et al. | |
| 6,286,803 | B1 | 9/2001 | Pellino et al. | |
| 6,421,928 | B1 * | 7/2002 | Miller | 33/520 |
| 6,612,046 | B1 * | 9/2003 | Cimorell et al. | 33/668 |
| 6,739,065 | B1 | 5/2004 | Hofmeister et al. | |
| 6,820,343 | B1 * | 11/2004 | Waibel et al. | 33/293 |
| 6,952,887 | B1 * | 10/2005 | Muchnik | 33/666 |
| 6,971,184 | B1 * | 12/2005 | Prevost | 33/613 |
| 7,028,413 | B1 * | 4/2006 | Filipescu | 33/528 |

* cited by examiner

*Primary Examiner*—Diego Gutierrez
*Assistant Examiner*—Amy R. Cohen
(74) *Attorney, Agent, or Firm*—Kelly Lowry & Kelley, LLP

(57) ABSTRACT

A picture hanging tool is provided for facilitated marking of a selected point on a wall or the like for subsequent installation of a fastener used for hanging a picture or other object from the wall. The tool includes an upper handle section adapted for manual grasping, and a lower support or base section having a hook or the like for temporarily supporting the object for movement over the wall surface to a selected precision mounting location. When the desired mounting location is obtained, an actuator mechanism including an actuator pin exposed on the upper handle section is operable to displace a spring-loaded marking element into engagement with the wall surface at the desired point for subsequent fastener installation. The tool is then removed from the wall, the fastener installed at the marked point, and the object hung from the installed fastener.

16 Claims, 1 Drawing Sheet

PICTURE HANGING TOOL

This application claims the benefit of U.S. Provisional Application 60/626,533, filed Nov. 9, 2004.

BACKGROUND OF THE INVENTION

This invention relates generally to devices and systems for use in hanging a picture or other selected object such as a work of art or the like on a vertical wall surface. More particularly, this invention relates to an improved and relatively easy-to-use picture hanging tool for facilitated precision positioning of the object on a wall, and for marking the wall at a selected location for subsequent mounting or installation of a hook-type or other suitable fastener used to hang or support the object on the wall.

Pictures and other objects such as a work or art or the like are typically hung from a vertical wall surface by one or more fasteners attached to the wall at a selected location or locations. One common picture hanging system utilizes a hook-type fastener attached to the wall by means of a nail or the like, and including an upwardly open hook for engaging a mated structure such as a wire or bracket mounted onto a rear face of the object. In general, the picture or the like is manually displaced vertically and horizontally relative to the wall surface until a desired mounting position is reached, at which time the fastener is attached to the wall and the object is hung from the fastener. However, it is often difficult to position the fastener with sufficient precision, whereby the actual process often proceeds in a trial-and-error manner with multiple fastener re-mountings until the object is hung on the wall at the desired position. This trial-and-error approach can be time-consuming and frustrating, and also results in numerous undesirable holes formed in the wall as the fastener is mounted and then relocated to a new mounting position.

A number of picture hanging tools have been developed in an attempt to facilitate the picture hanging process, particularly with respect to reducing trial-and-error re-adjustment of the fastener position. See, for example, U.S. Pat. Nos. 5,180,135; 5,520,318; 6,739,065; 6,286,803; 5,867,917; 5,129,154; 5,109,611; 6,049,991; 4,455,756; 4,473,957; 5,471,760; and 3,516,165. Some of these devices are designed for assembly with a picture or other object to be hung, and for manipulation over the wall surface to a desired hanging position followed by marking the wall with a pointed tip stylus or the like for facilitated subsequent installation of a fastener. Other devices incorporate means for positioning the picture or the like on the wall, and then directly installing the fastener. In general, however, these prior devices are relatively difficult to grasp and use, and are not optimally adapted for marking the wall in a clear easy-to-see manner.

There exists, therefore, a need for further improvements in and to devices and systems for use in hanging a picture or the like from a wall surface, particularly with respect to a device for quickly and easily marking the wall in a clear and unambiguous manner at a location for subsequent fastener installation. The present invention fulfills these needs and provides further related advantages.

SUMMARY OF THE INVENTION

In accordance with the invention, a picture hanging tool is provided for facilitated marking of a selected point on a wall or the like for subsequent installation of a fastener used for hanging a picture or other object from the wall. The picture hanging tool comprises an upper handle section shaped for easy manual grasping, and a lower base or support section having a front hook or the like for temporarily supporting the object. The tool with picture or other object supported thereon is moved over the wall surface to a selected precision mounting location, whereupon an actuator mechanism including an actuator pin exposed on the upper handle section is operable to displace a spring-loaded marking element into engagement with the wall surface at the desired point for subsequent fastener installation. The tool is then removed from the wall, the fastener installed at the marked point, and the object hung from the installed fastener.

In the preferred form of the invention, the upper handle section is joined to the lower base section by means of an intermediate neck section which spaces or offsets the handle section forwardly relative to the base section. A rearwardly protruding stabilizer bar projects rearwardly from an upper end of the handle section. Accordingly, when the lower base section is placed against a wall surface, the neck section and stabilizer bar cooperate to position the handle section in spaced relation to the wall surface, thereby permitting easy manual grasping of the handle section as the tool is slidably displaced over the wall surface in a stable manner to move the supported picture or other object to a desired installation position.

The upper handle section cooperates with the intermediate neck section and lower base section to define a hollow tool interior having the actuator mechanism mounted therein. In a preferred form, the actuator mechanism comprises an elongated, vertically offset shaft or rod having an upper end with a plunger pin thereon protruding a short distance from the top of the upper handle section, and a lower end within the housing shaped to define an angled cam surface. This cam surface is positioned to engage a marking element such as a felt tip marker or the like movable between a normal, spring-loaded retracted position retracted from the adjacent wall surface, and an advanced position projecting rearwardly from the base section to mark the adjacent wall surface. When the picture or other object is moved to the desired installation position, the plunger pin is manually depressed by the user's thumb or the like, while continuing to hold the tool against the wall surface, resulting in cam-actuated rearward movement of the marking element into marking engagement with the wall surface. Importantly, the marking element is disposed substantially in horizontal alignment with the front hook supporting the picture or the like.

After marking, the tool with picture or the like supported therefrom is removed from the wall, and a suitable fastener is installed at the marked point on the wall. In this regard, the fastener may be selected from a group of fasteners conveniently supported and stored within the hollow tool housing, and accessible via an access panel or door.

Other features and advantages of the present invention will become apparent from the following more detailed description, taken in connection with the accompanying drawing which illustrate, by way of example, the principals of the present invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
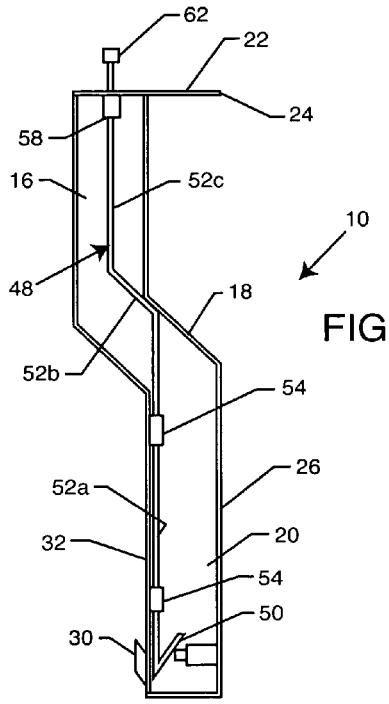
FIG. 1 is a side elevation view of a picture hanging tool embodying the novel features of the invention.
Figure 2:
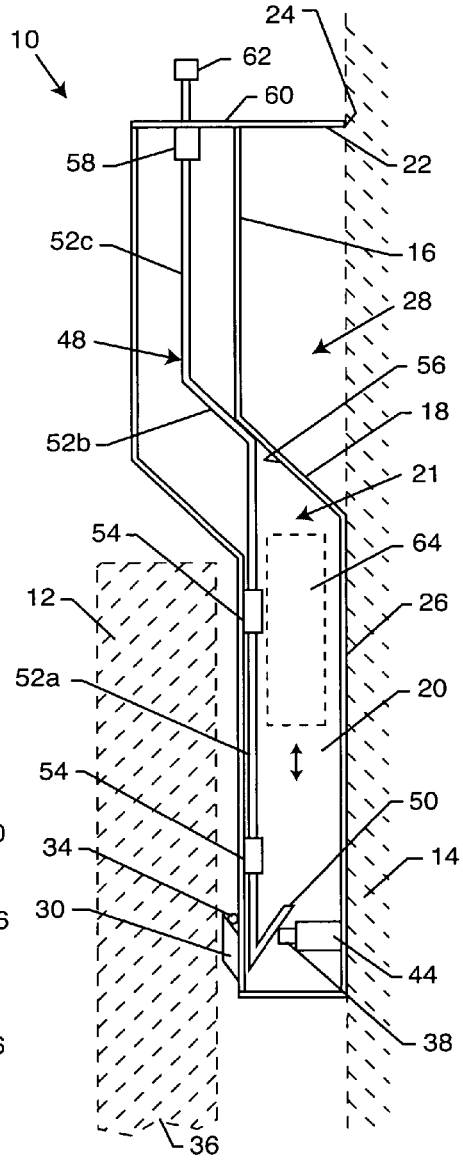
FIG. 2 is an enlarged and fragmented vertical section illustrating use of the picture hanging tool of FIG. 1 for facilitated marking of a wall at a selected location for subsequent mounting of a suitable fastener for hanging a picture or the like on the wall.
Figure 3:
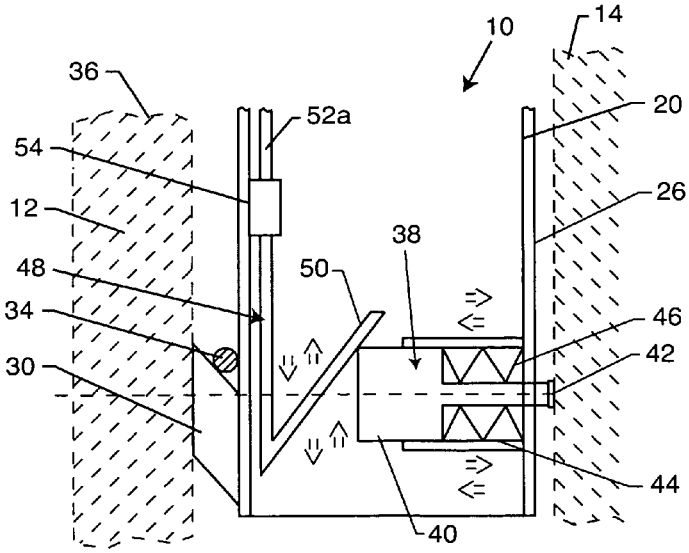
FIG. 3 is an enlarged fragmented vertical section of a portion of the picture hanging tool as shown in FIG. 2, but depicting the tool in an actuated position for marking the wall.

As shown in the exemplary drawings, an improved tool referred to generally in FIGS. 1–3 by the reference numeral 10 is provided for use in quickly and easily hanging a picture 12 (FIGS. 2–3) or other selected object at a precision and predetermined location on the vertical surface of a wall 14. The picture hanging tool 10 comprises a unitized device adapted for facilitated one-handed manipulation and operation to selectively orient the object 12 on the wall 14 at a desired installation position, and then to mark a point on the wall 14 for subsequent installation of a suitable fastener (not shown) used for hanging the object 12 at said desired installation position.

In the preferred form as shown, the picture hanging tool 10 comprises a relatively compact unitary housing which may be constructed from lightweight molded plastic components to include an upper handle section 16 joined by means of an intermediate neck section 18 to a lower support or base section 20. These housing sections preferably define a unitary hollow housing interior 21. The upper handle section 16 and the lower base section 20 are vertically elongated and oriented in generally parallel relation, with the neck section 18 providing an offset for spacing the handle section 16 forwardly relative to the lower base section 20. FIGS. 1–2 show the intermediate neck section 18 oriented to extend upwardly and forwardly from an upper end of the base section 20, at an angle of about 45°, for connection to a lower end of the handle section 16. Persons skilled in the art will recognize and appreciate, however, that the particular angular orientation of the neck section 18 may vary.

A stabilizer bar 22 protrudes rearwardly from an upper end of the handle section 16, terminating in a rearward margin 24 aligned vertically, or generally coplanar with a rear face 26 of the lower base section 20. With this construction, the entire tool 10 can be held firmly and securely against the wall 14, by manually grasping the upper handle section 16 with one hand, and then pressing the rearward margin 24 of the stabilizer bar 22 and the rear face 26 of the base section 20 firmly against the wall. The forwardly offset upper handle section 16 is thus spaced forwardly from the wall 14, as indicated by arrow 28 in FIG. 2, for facilitated manual grasping by wrapping the user's fingers about the handle section 16.

A support element such as a hook 30 or the like is carried on a front face 32 of the lower base section 20 at or near a lower end thereof. This hook 30 is oriented to define an upwardly open pocket for temporary receipt and support of a hanger element 34 mounted on a rear side of the picture or other object 12 to be mounted onto the wall 14. In this regard, the illustrative drawings (FIGS. 2–3) show the hanger element 34 in the form of a conventional wire attached at opposite ends (not shown) to the frame 36 of the picture or the like to be hung. Persons skilled in the art will understand that a variety of alternative hanger elements such as brackets and the like may be employed.

A marking element 38 is also carried within the hollow housing interior 21 at a position near the lower end of the lower base section 20, and oriented generally in horizontal alignment with the front hook 32. This marking element 38 is shown best in FIG. 3 in the form of a felt type marker having a body 40 with a marker tip 42 protruding rearwardly therefrom. The marker body 40 is slidably carried within a track 44 for fore-aft sliding displacement through a short stroke between a rearwardly advanced position (FIG. 3) with the tip 42 protruding rearwardly from the rear face 26 of the base section 20 to mark the wall 14, and a retracted position (FIG. 2) with the tip 42 retracted at least slightly into the lower base section, and from the wall 14 to avoid marking thereof. Spring means such as a spring 46 (FIG. 3) reacts between the marker body 40 and an inboard side of the housing lower base 20 for normally biasing the marking element 38 to the retracted position (FIG. 2).

An actuator mechanism 48 is provided for displacing the marking element 38 from the normal retracted position (FIG. 2) to the rearwardly advanced position (FIG. 3) to mark a point on the wall 14, corresponding with a desired point for subsequent installation of a mounting fastener to hang the picture or the like. In the preferred form as shown, the actuator mechanism comprises an angled cam 50 projecting upwardly and rearwardly from a lower end of a vertically elongated and longitudinally stiff actuator shaft or rod extending upwardly through the hollow interior 21 of the tool housing. As shown best in FIG. 2, the actuator rod has a lower segment 52*a* slidably supporting by a vertically spaced pair of guide bushings 54, and then merges with an upwardly and forwardly angled intermediate rod segment 52*b* extending generally through the neck section 18 of the housing. This intermediate rod segment 52*b* is conveniently oriented to abut an inboard face 56 of the neck section 18, when the marking element 38 is in the retracted position (FIG. 2). The intermediate rod segment 52*b* merges in turn with an upper actuator rod segment 52c that is slidably supported by another guide bushing 58, and then protrudes a short distance upwardly from a top surface 60 of the upper handle section 16. An enlarged plunger pin 62 is mounted on the exposed upper end of the upper segment 52*c* of the actuator rod.

The plunger pin 62 is positioned for convenient fingertip depression as by pressing downwardly with the user's thumb (not shown) for manually displacing the actuator rod through a short downward stroke, from a first position to a second position. Such movement displaces the cam 50 in a downward direction, with the cam being oriented to displace the marking element 38 rearwardly against the biasing spring 46 to press the marker tip 42 against the wall 14 to mark a point thereon. Upon release of the plunger pin 62, the biasing spring 46 presses the body 40 of the marking element 38 in a forward direction against the cam 50, resulting in upward shifting of the actuator rod toward the initial first position, until the intermediate segment 52*b* thereof engages and stops against the inboard face 56 of the neck section 18, as previously described.

Accordingly, the picture hanging tool 10 of the present invention is used by temporarily supporting a picture 12 or the like by means of the front hook 30 on the lower base section 20. The tool 10 with picture supported thereon is then placed against the wall 14 and the tool 10 is shifted relative to the wall until a desired precision picture mounting location is achieved. In this regard, the fore-aft dimension of the lower base section 20 is preferably minimized so that the picture or other object to be hung can be positioned close to the wall 14. In addition, for facilitated maneuvering of the tool with the picture 12 or the like supported thereon, the upper handle section 16 of the tool is preferably disposed substantially in-line vertically above the frame 36 of the like of the object 12.

When the desired mounting position is reached, while continuing to hold the tool 10 and picture 12 at the desired installation position, the user depresses the plunger pin 62 to advance the marking element 38 for marking a point on the wall 14. The plunger pin 62 is then released to permit spring-actuated retraction of the marking element 38 from the wall 14, and the tool 10 with picture 12 supported thereon is removed from the wall. The marked point on the wall 14 provides a clear and accurate indication of the point for mounting a suitable fastener (not shown) used for permanently mounting the picture 12 or the like on the wall 14.

One or more fasteners may be conveniently supported and stored within the hollow interior 21 of the tool housing, and accessed by means of an access panel or door 64 (FIG. 3), if desired. This access panel 64 may be designed for snap-fit removable mounting, or hinged mounting relative to the tool housing.

Although an embodiment has been described in detail for purposes of illustration, various modifications may be made without departing from the scope and spirit of the invention. Accordingly, no limitation on the invention is intended by way of the foregoing description and accompanying drawings, except as set forth in the appended claims.

What is claimed is:

1. A tool for use in marking a vertical wall surface for subsequent installation of at least one fastener to hang a picture or other object from the vertical wall surface, said installation tool comprising:

a tool housing including a lower base section having a rear face for placement against the vertical wall surface, and a manually graspable upper handle section offset forwardly relative to said lower base section, said tool housing further includes an intermediate neck section extending upwardly and angularly forwardly from said lower base section to said upper handle section;

a support element carried by said lower base section for temporary receipt and support of a hanger element mounted on a rear side of the picture or other object;

a marking element including a marker tip carried by said lower base section for generally fore-aft displacement between a rearwardly advanced position with said marker tip protruding rearwardly beyond said lower base section rear face to mark a vertical wall surface at a point generally aligned with said support element, and a retracted position with said marker tip retracted at least slightly into said lower base section to avoid marking the vertical wall surface;

an actuator mechanism including an elongated actuator rod carried by said tool housing for movement between first and second positions, said actuator rod having an externally exposed upper end for manual depression to shift said actuator rod from said first position to said second position, and an angled cam generally at a lower end of said actuator rod and responsive to actuator rod movement to said second position for engaging and displacing said marking element from said retracted position to said rearwardly advanced position; and spring means for normally biasing said marking element toward said retracted position, and for normally biasing said actuator rod toward said first position.

2. The tool of claim 1 wherein said support element is carried on a front face of said lower base section.

3. The tool of claim 1 wherein said support element comprises a hook.

4. The tool of claim 1 wherein said tool housing comprises a hollow plastic structure.

5. The tool of claim 1 wherein said actuator rod includes a lower segment carried within said housing lower base section, an upper segment carried within said housing upper handle section, and an intermediate segment extending angularly therebetween within said housing intermediate neck segment, and further including guide bushings within said housing for supporting said actuator rod for movement between said first and second positions.

6. The tool of claim 1 further including a plunger pin at said actuator rod upper end.

7. The tool of claim 1 wherein said actuator rod upper end is externally exposed at an upper end of said housing upper handle section.

8. The tool of claim 1 further including a stabilizer bar protruding rearwardly from said housing upper handle section generally at an upper end thereof, said stabilizer bar defining a rearward margin disposed generally coplanar with said rear face of said housing lower base section.

9. The tool of claim 1 further including an access panel carried by said tool housing.

10. A tool for use in marking a vertical wall surface for subsequent installation of at least one fastener to hang a picture or other object from the vertical wall surface, said installation tool comprising:

a tool housing including a lower base section having a rear face for placement against the vertical wall surface, and a manually graspable upper handle section offset forwardly relative to said lower base section;

a stabilizer bar protruding rearwardlyfrom said housing upper handle section generally at an upper end thereof and defining a rearward margin disposed generally coplanar with said rear face of said housing lower base section;

a support element carried by said lower base section for temporary receipt and support of a hanger element mounted on a rear side of the picture or other object;

a marking element including a marker tip carried by said lower base section for generally fore-aft displacement between a rearwardly advanced position with said marker tip protruding rearwardly beyond said lower base section rear face to mark a vertical wall surface at a point generally aligned with said support element, and a retracted position with said marker tip retracted at least slightly into said lower base section to avoid marking the vertical wall surface;

an actuator mechanism including an elongated actuator rod carried by said tool housing for movement between first and second positions, said actuator rod having an externally exposed upper end for manual depression to shift said actuator rod from said first position to said second position, and an angled cam generally at a lower end of said actuator rod and responsive to actuator rod movement to said second position for engaging and displacing said marking element from said retracted position to said rearwardly advanced position; and spring means for normally biasing said marking element toward said retracted position, and for normally biasing said actuator rod toward said first position.

11. The tool of claim 10 wherein said tool housing comprises a hollow structure.

12. The tool of claim 11 wherein said tool housing further includes an intermediate neck section extending upwardly and angularly forwardly from said lower base section to said upper handle section; and further wherein said actuator rod includes a lower segment carried within said housing lower base section, an upper segment carried within said housing upper handle section, and an intermediate segment extending angularly therebetween within said housing intermediate neck segment, and further including guide bushings within said housing for supporting said actuator rod for movement between said first and second positions.

13. A tool for use in marking a vertical wall surface for subsequent installation of at least one fastener to hang a picture or other object from the vertical wall surface, said installation tool comprising:

a tool housing adapted for sliding placement against a vertical wall surface to a selected position thereon for hanging the picture or other object, said tool housing including a lower base section having a support element for temporary support of the picture or other object, said lower base section further including a marking element aligned generally with said support element and movable between a normal retracted position to avoid marking the wall surface and a rearwardly advanced position in marking engagement with the wall surface;

said tool housing further including an upper handle section adapted for manual grasping for manipulating the tool relative to the wall surface, said upper handle section being spaced from the wall surface when a rear face of said lower base section is slidably engaged with the wall surface; and a stabilizer bar protruding rearwardly from said housing upper handle section generally at an upper end thereof and defining a rearward margin disposed generally coplanar with a rear face of said housing lower base section, said upper handle section including a manually operated actuator mechanism linked with said marking element for displacing said marking element from said retracted position to said rearwardly advanced position.

14. The tool of claim 13 wherein said actuator mechanism includes an externally exposed plunger pin.

15. The tool of claim 13 wherein said upper handle section and said actuator mechanism are adapted for one-handed manipulation.

16. The tool of claim 13 further including spring means for normally biasing said marking element toward said retracted position.

* * * * *